US007586213B2

(12) United States Patent
Vegter

(10) Patent No.: US 7,586,213 B2
(45) Date of Patent: Sep. 8, 2009

(54) CONTROL CIRCUIT FOR RELAY-OPERATED GAS VALVES

(75) Inventor: Derk Vegter, Nieuw Amsterdam (NL)

(73) Assignee: Honeywell International Inc., Morristown, NJ (US)

( * ) Notice: Subject to any disclaimer, the term of this patent is extended or adjusted under 35 U.S.C. 154(b) by 286 days.

(21) Appl. No.: 10/599,548

(22) PCT Filed: Mar. 17, 2005

(86) PCT No.: PCT/EP2005/002856

§ 371 (c)(1),
(2), (4) Date: Sep. 29, 2006

(87) PCT Pub. No.: WO2005/098888

PCT Pub. Date: Oct. 20, 2005

(65) Prior Publication Data

US 2007/0159761 A1 Jul. 12, 2007

(30) Foreign Application Priority Data

Apr. 1, 2004 (DE) ..... 10 2004 016 764
Sep. 15, 2004 (DE) ..... 10 2004 045 031

(51) Int. Cl.
*H01H 47/20* (2006.01)

(52) U.S. Cl. ..... 307/116; 307/129

(58) Field of Classification Search ..... None
See application file for complete search history.

(56) References Cited

U.S. PATENT DOCUMENTS

| | | | | |
|---|---|---|---|---|
| 3,715,669 | A | 2/1973 | Faforest | |
| 4,118,750 | A | 10/1978 | Auer et al. | |
| 5,865,538 | A | 2/1999 | Walker et al. | |
| 5,889,645 | A * | 3/1999 | Kadah et al. | 361/191 |
| 5,917,691 | A | 6/1999 | Kadah | |

FOREIGN PATENT DOCUMENTS

| | | |
|---|---|---|
| DE | 10203765 | 8/2003 |
| DE | 102004016764 | 9/2005 |

* cited by examiner

*Primary Examiner*—Stephen W Jackson
*Assistant Examiner*—Adi Amrany

(57) ABSTRACT

A control circuit and methods for controlling gas valves via a relay are provided. In one illustrative embodiment, a control circuit includes or is connected to a relay that controls the opening and/or closing of a gas valve. The control circuit may also include a failsafe circuit that has at least one input that can be connected to a control device and at least one output that can be connected to the relay. In some cases, the fail-safe circuit may only supply an output voltage and/or current to the replay for opening the gas valve if the input signal received from the control device includes at least two different successively applied frequency signals. Other methods and embodiments are also contemplated.

13 Claims, 2 Drawing Sheets

CONTROL CIRCUIT FOR RELAY-OPERATED GAS VALVES

Figure 1:
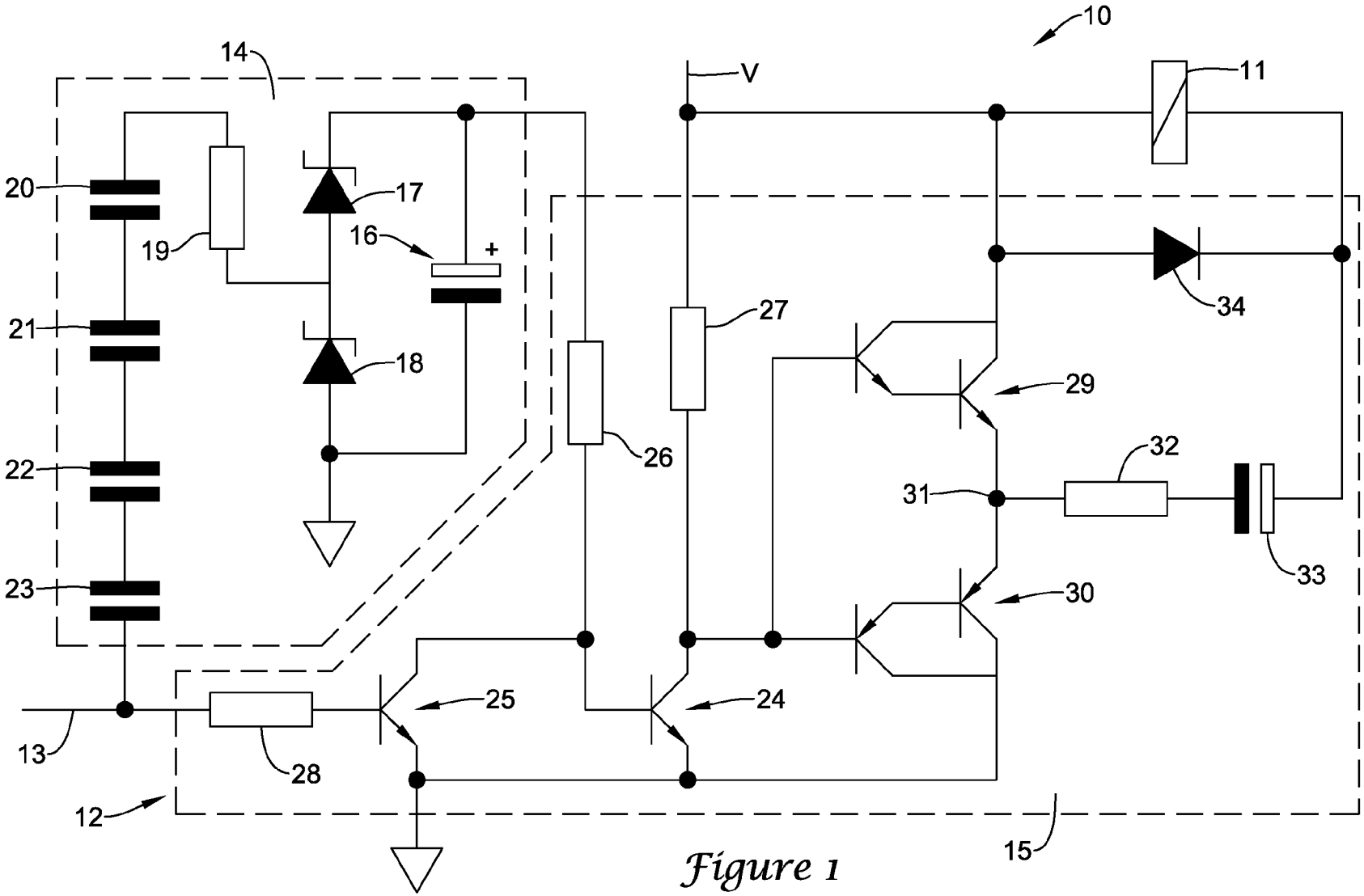

This application claims priority to PCT/EP2005/002856, filed on Mar. 17, 2005, which claims priority to DE102004045031.5 filed on Sep. 15, 2004 and to DE102004016764.8 filed on Apr. 1, 2004.

TECHNICAL FIELD

The invention relates to a control circuit for relay-operated gas valves.

BACKGROUND

Gas valves are known which are opened and closed via a relay. It is also known for such relays for opening and closing gas valves to be activated via a control device, often in the form of a microprocessor. It can be important here that the overall arrangement is failsafe, i.e. that a gas valve is only opened via a relay when the control device is in a defined state. If an undefined state of the control device is present, it is desirable that the relay not open the gas valve. For this, control circuits for relay-operated gas valves sometimes have a failsafe circuit in addition to the relay, where the failsafe circuit is connected between the control device and the relay. The failsafe circuit may help ensure the failure safety of the overall arrangement.

SUMMARY

According to one illustrative embodiment of the present invention, a control circuit may be provided that includes a relay for opening and/or closing a gas valve, and a failsafe circuit. A control device may be connectable to one or more input of the failsafe circuit, and the failsafe circuit may be adapted to only supply the relay with a voltage and/or current necessary for opening the gas valve when an input signal supplied at an input of the failsafe circuit by the control device has, for example, at least two different frequency signals succeeding each other in time.

In accordance with this illustrative embodiment, the relay can accordingly only open a gas valve if the signal supplied by the control device contains the two frequency signals in the time-defined order. If only one of the two frequency signals is present, the relay cannot open the gas valve. This helps ensure that the relay can only actuate the gas valve if the control device, often in the form of a microprocessor, is working properly. If the control device supplies a signal with other frequencies or a different time sequence of frequencies at the input of the failsafe circuit, the gas valve may be closed, sometimes immediately.

In some illustrative embodiments, the control circuit may have a charging circuit and a drive circuit for the relay. In some cases, the charging circuit has at least one capacitor, the charging circuit charging the at least one capacitor of the charging circuit upon the application or presence of a first frequency signal in the input signal. Upon the application or presence of a second frequency signal, on the other hand, the at least one capacitor of the charging circuit discharges itself. Upon the application or presence of the second frequency signal in the input signal, the drive circuit for the relay may supply the relay with a voltage and/or current necessary for opening the gas valve.

In some cases, the drive circuit may have at least two transistors, a base of a first transistor being connected via a resistor to the capacitor of the charging circuit, and the first transistor of the drive circuit only conducting when the capacitor of the charging circuit discharges itself upon the application of the second frequency signal in the input signal.

BRIEF DESCRIPTION

Figure 2:
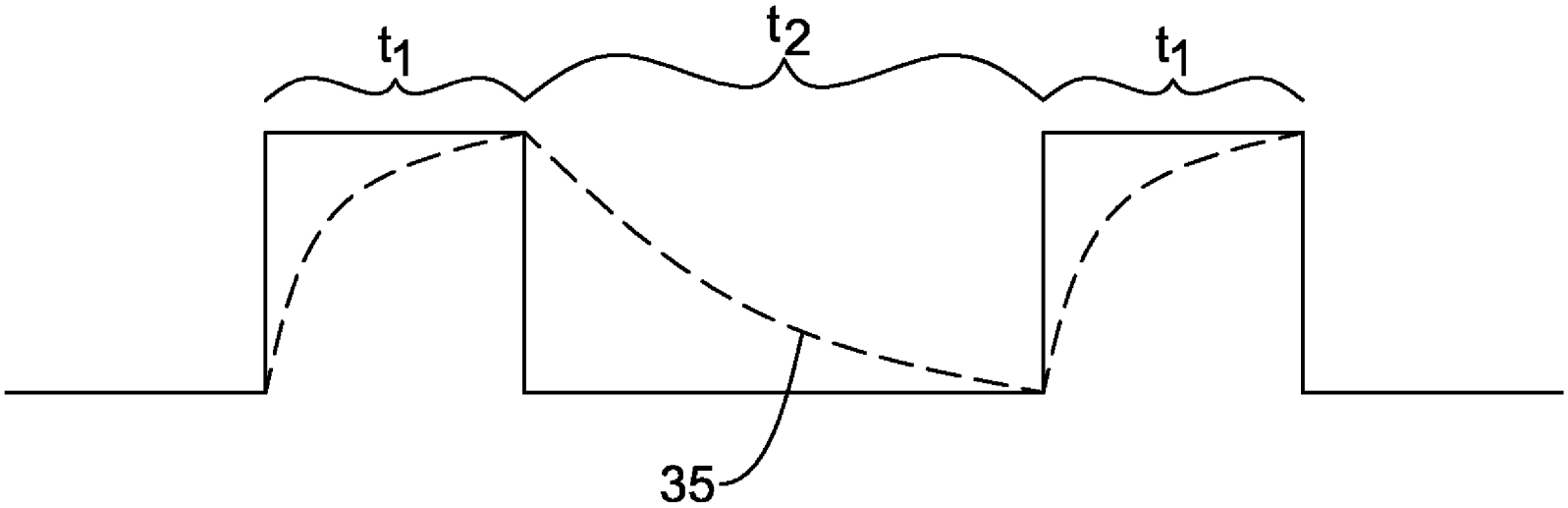

The invention may be more completely understood in consideration of the following detailed description of an illustrative embodiment of the present invention in connection with the accompanying drawings, without being restricted to this or other illustrative embodiments, in which:

FIG. 1 shows a circuit diagram of an illustrative control circuit that can be used in conjunction with relay-operated gas valves; and FIG. 2 shows a timing diagram for clarifying the functioning of the illustrative control circuit of FIG. 1.

An illustrative embodiment of the present invention will now be described in greater detail with reference to FIG. 1 and FIG. 2.

FIG. 1 shows a control circuit 10 according to one illustrative embodiment for relay-operated gas valves. The illustrative control circuit includes a relay 11 and a failsafe circuit 12 for the relay 11. The illustrative failsafe circuit 12 has an input 13, at which a control device, not shown, in particular a control device such as a microprocessor, can be connected. The control device supplies an input signal at the input 13 of the failsafe circuit 12 or at the input 13 of the control circuit 10. The failsafe circuit 12 may be adapted to then only supply at the relay 11 a voltage and/or current necessary for opening the gas valve when, for example, a signal having at least two different frequency signals succeeding each other in time is supplied at the input 13 by the control device.

In one illustrative embodiment, and not to be limiting, the failsafe circuit 12 of the control circuit 10 may include a charging circuit 14 and a drive circuit 15. The illustrative charging circuit 14 includes the components surrounded by a dashed box in FIG. 1; the components of the drive circuit 15 are surrounded in FIG. 1 by a dotted and dashed box.

As can be seen from FIG. 1, the illustrative charging circuit 14 includes a capacitor 16, with two diodes 17 and 18 connected in parallel to the capacitor 16. FIG. 1 shows that the cathode of the diode 18 is in contact with the anode of the diode 17. The capacitor 16 is connected in parallel to the two diodes 17 and 18 in such a manner that the capacitor is in contact with the cathode of the diode 17 on one side and with the anode of the diode 18 on the other side. Connected between the two diodes 17 and 18 is a resistor 19, which with interposed capacitors 20, 21, 22 and 23 is connected to the input 13 of the failsafe circuit 12. Instead of the four capacitors 20 to 23 shown in FIG. 1, it is also possible to use only one capacitor, or any other number of capacitors as desired of appropriately sized capacity.

The illustrative drive circuit 15 includes, among other things, two transistors 24 and 25. A first transistor 24 is connected with its base to the capacitor 16 of the charging circuit 14, with an interposed resistor 26. The collector of the transistor 24, which according to the illustrative embodiment of FIG. 1, is developed as an NPN transistor, is connected with an interposed further resistor 27 to a supply voltage V of the control circuit 10. With its emitter, on the other hand, the transistor 24 is connected to a ground potential or earth potential. A second transistor 25 is switched with the first transistor 24 in such a manner that the collector of the second transistor 25, which like the first transistor 24 is developed as an NPN transistor, is connected to the base of the first transistor 24. The emitter of the second transistor 25 is connected, like the emitter of the first transistor 24, to the ground potential or earth potential. The base of the second transistor 25 is connected with an interposed resistor 28 to the input 13 of the control circuit 10.

According to the illustrative embodiment of FIG. 1, the illustrative drive circuit 15 may include, in addition to the two transistors 24, 25 and the resistors 26, 27 and 28, two Darlington transistor circuits 29 and 30, each of which has two transistors switched in the so-called Darlington circuit. According to FIG. 1, the two transistors of the Darlington transistor circuit 29 are developed as NPN transistors, the two transistors of the Darlington transistor circuit 30 on the other hand being developed as PNP transistors. In the illustrative embodiment, the two Darlington transistor circuits 29 and 30 are connected together at their base and coupled to the collector of transistor 24. It can further be seen from FIG. 1 that the emitters of the Darlington transistor circuits 29 and 30 may also be connected to each other, a series connection of a resistor 32 and a capacitor 33 being in contact at this connection point 31 of the emitters. The collector of the Darlington transistor circuit 29 is shown connected to the potential of the supply voltage V; the collector of the Darlington transistor circuit 30, on the other hand, is shown connected to the ground potential together with the emitters of the transistors 24 and 25. A diode 34 is connected in parallel to the relay 11, the diode 34 being connected with its anode coupled to the collector of the Darlington transistor circuit 29 and with its cathode coupled to the capacitor 33.

As already mentioned, the illustrative control circuit 10 or the failsafe circuit 12 of the same may only supply the relay 11 with a voltage necessary for opening the gas valve when, for example, an input signal including at least two different frequency signals succeeding each other in time is supplied at the input 13 of the failsafe circuit 12 by the control device. In this case a defined operating state of the control device for opening the gas valve is present.

In one illustrative embodiment, and although not required, the gas valve may be only opened by the relay 11 if the signal supplied by the control device at the input 13 includes two frequency signals, namely a first frequency signal with a frequency of around 1000 kHz and a second frequency signal with a frequency of around 5 kHz, which are applied or present succeeding one another in time in such a manner in the signal supplied by the control device, that in each case a time span of around 40 ms with the first frequency signal of around 1000 kHz is followed by a time span of around 80 ms with the second frequency signal of around 5 kHz. FIG. 2 visualizes such an input signal, as supplied by the control device, as a solid line, where in each case a time span $t_1$ with the frequency signal of around 1000 kHz is followed by a time span $t_2$ with the frequency signal of around 5 kHz.

The illustrative control circuit 10 may work in such a manner that upon the application or presence of the first frequency signal of around 1000 kHz at the input 13 of the failsafe circuit 12, the charging circuit 14 charges the capacitor 16 of same. During the application of the second frequency signal of around 5 kHz at the input 13, on the other hand, the capacitor 16 of the charging circuit 14 cannot be charged, but instead during the time span in which the second frequency signal of around 5 kHz is applied, a discharge of the capacitor 16 of the charging circuit 14 takes place through the resistor 26 and the base of the transistor 24. It should further be noted that during the time span in which the second frequency signal of around 5 kHz is applied at the input 13, there may be a generally rectangular 5 kHz signal at the connection point 31. Thereby, on the one hand, the capacitor 33 of the drive circuit 15 is charged over the diode 34, and on the other hand there is a discharge over the relay 11. In the discharge, a direct current may flow through the relay 11. In the time span in which the first frequency signal of around 1000 kHz is applied, the capacitor 33 of the drive circuit 15 can also discharge over the relay 11. In the illustrative embodiment, the transistor 24 of the drive circuit 15 is only conducting if from the discharge of the capacitor 16 a current flows at its base.

During the time span in which the first frequency signal with the relatively high frequency of around 1000 kHz is applied at the input 13, the capacitor 16 of the charging circuit 14 is indeed being charged, but the drive circuit 15 is not conducting because of, for example, the so-called feedback capacity of the transistor 25 and because of the relatively large resistor 28. In the illustrative embodiment, the drive circuit 15 is only conducting when, during the time span in which the second frequency signal with the relatively low frequency of 5 kHz is applied at the input 13, the capacitor 16 of the charging circuit 14 discharges through the resistor 26 and the base of the first transistor 24. The charging and discharging of the capacitor 16 of the charging circuit 14 during the time spans $t_1$ and $t_2$ with the different frequency signals is represented in FIG. 2 by the broken line 35. As can be seen from FIG. 2, the capacitor 16 is charged during the time span $t_1$ in which the first frequency signal of around 1000 kHz is applied, while a discharge of the capacitor 16 occurs during the time span $t_2$ in which the second frequency signal of around 5 kHZ is applied.

By supplying a signal at the input 13 of the control circuit 10, in which the signal includes the two frequency signals of around 1000 kHz and around 5 kHz succeeding each other in a defined time, a voltage and/or current necessary to open the gas valve can be permanently supplied at the relay 11. In the time span in which the first frequency signal of around 1000 kHz is applied at the input 13, the capacitor 33 of the drive circuit 15 discharges, as a result of which the voltage and/or current necessary to open the gas valve is maintained at the relay 11. During the time span for which the second frequency signal of around 5 kHz is applied at the input 13 and the capacitor 16 of the charging circuit 14 discharges, the drive circuit 15 is conducting and there is a rectangular 5 kHz signal at the connection point 31. As a result of this, on the one hand the capacitor 33 is charged over the diode 34, and on the other hand there is a discharge over the relay 11. In the discharge a direct current flows through the relay 11. During the presence of the first frequency signal of around 1000 kHz, the transistor 25 is continuously conducting, as a result of which the voltage at the emitters of the Darlington transistor circuits 29 and 30 becomes high. Since during the time span in which the first frequency signal of around 1000 kHz is applied at the input 13, the voltage necessary to open the gas valve is maintained at the relay 11 by the discharge of the capacitor 33, this time typically should be shorter than the discharge time of the capacitor 33.

The actual design of the control circuit described above is up to the person skilled in the art who is addressed here. In the especially preferred embodiment, the capacitance of the capacitor 16 of the charging circuit is 10 μF, the capacitance of each of the capacitors 20, 21, 22, 23 is 100 pF. The capacitance of the capacitor 33 of the drive circuit is preferably 47 μF. The resistor 19 is preferably sized at 1 kΩ, the resistor 28 at 1 MΩ. The resistor 26 is preferably 47 kΩ, the resistor 27 100 kΩ. The resistor 32 is preferably 51Ω. The supply voltage V is 24 V. With this sizing for the circuit components, the discharge time of the capacitor 16 through the resistor 26 is about 116 ms, its charge time is about 40 ms.

REFERENCE NUMBER LIST

10 Control circuit
11 Relay
12 Failsafe circuit
13 Input
14 Charging circuit
15 Drive circuit
16 Capacitor
17 Diode
18 Diode
19 Resistor
20 Capacitor
21 Capacitor
22 Capacitor
23 Capacitor
24 Transistor
25 Transistor
26 Resistor
27 Resistor
28 Resistor
29 Darlington transistor circuit
30 Darlington transistor circuit
31 Connection point
32 Resistor
33 Capacitor
34 Diode

The invention claimed is:

1. A control circuit for relay-operated gas valves comprising:

a relay for opening and/or closing a gas valve;

a failsafe circuit for the relay, the failsafe circuit including:

a charging circuit having at least one capacitor including a charging capacitor;

a drive circuit coupled to the relay having an input transistor, a base of the input transistor being electrically connected to the charging capacitor of the charging circuit; and a control device being connectable to an input of the failsafe circuit, the failsafe circuit only supplying the relay with a voltage and/or current necessary for opening the gas valve when an input signal having at least two different frequency signals succeeding each other in time is supplied at the input of the failsafe circuit by the control device;

wherein, upon the application of a first frequency signal at the input of the failsafe circuit, the charging circuit charges the charging capacitor, and upon the application of a second frequency signal at the input of the failsafe circuit, the second frequency signal having a different frequency that the first frequency signal, the charging circuit does not charge the charging capacitor, and the charging capacitor when sufficiently charged, provides a bias to the input transistor of the drive circuit that enables the input transistor of the drive circuit;

wherein the drive circuit, upon the application of the second frequency signal at the input of the failsafe circuit, supplies the relay with a voltage and/or current necessary for opening the gas valve but only if the charging capacitor is sufficiently charged by the first frequency signal to provide the necessary bias to the input transistor of the drive circuit to enable the input transistor of the drive circuit to pass the second frequency signal.

2. The control circuit of claim 1, wherein the charging circuit charges the charging capacitor exclusively upon the application of the first frequency signal at the input of the failsafe circuit.

3. The control circuit of claim 1, wherein the charging circuit, upon the application of a second frequency signal at the input of the failsafe circuit, does not charge the charging capacitor of the charging circuit.

4. The control circuit of claim 1, wherein the input transistor of the drive circuit has a collector terminal, an emitter terminal and a base terminal, the collector terminal of the input transistor is connected via an interposed resistor to a supply voltage, and the emitter terminal of the input transistor is connected to a ground potential.

5. The control circuit of claim 4, wherein the drive circuit further includes a second transistor having a collector terminal, an emitter terminal and a base terminal, the base terminal of the second transistor receives the second frequency that is presented at the input of the failsafe circuit, the collector terminal of the second transistor is connected to the base of the input transistor, and the emitter terminal of the second transistor is connected to a ground potential.

6. The control circuit of claim 1, wherein the drive circuit further includes two Darlington transistor circuits connected together at a drive node, a diode connected in parallel to the relay, and a series connected resistor and capacitor connected between the drive node and the relay.

7. The control circuit of claim 1, wherein the first frequency signal has a frequency of around 1000 kHz and the second frequency signal has a frequency of around 5 kHz, the two frequency signals being applied at the input of the failsafe circuit succeeding one another in time in such a manner that in each case a time span of around 40 ms with the first frequency signal of around 1000 kHz is followed by a time span of around 80 ms with the second frequency signal of around 5 kHz.

8. The control circuit of claim 1, wherein the failsafe circuit only supplies the relay with a voltage and/or current necessary for opening the gas valve if the two different frequency signals are applied succeeding each other in time in accordance with a predetermined definition.

9. The control circuit of claim 1, wherein the first frequency signal and the second frequency signal are applied successively at the input of the failsafe circuit in such a way that a first time period with the first frequency signal is respectively followed by a second time period with the second frequency signal.

10. A fail-safe circuit for controlling a relay that controls the opening of a gas valve, the fail-safe circuit comprising:

at least one input that can be connected to a gas valve controller;

at least one output that can be connected to the relay;

a charging circuit having a charging capacitor; and a drive circuit having at least one transistor and a drive capacitor;

wherein the fail-safe circuit is configured to only supply an output signal to the relay to open the gas valve via the at least one output of the fail safe circuit if/when the gas valve controller provides an input signal having at least a first frequency signal and a different second frequency signal to the at least one input of the fail-safe circuit;

wherein, during the period of the first frequency signal, the charging capacitor charges, and the drive capacitor discharges to provide a relay current to the relay; and further wherein, during the period of the second frequency signal, the charging capacitor discharges into the base of the at least one transistor of the drive circuit, which causes the drive circuit to charge the drive capacitor and to provide a relay current to the relay.

11. The fail-safe circuit of claim 10 wherein the fail-safe circuit is configured to only supply the relay current to the relay to open the gas valve via the at least one output of the fail safe circuit when the gas valve controller provides the input signal such that the first frequency signal is coordinated in time with the second frequency signal.

12. The fail-safe circuit of claim 10 wherein the fail-safe circuit is configured to only supply the relay current to the relay to open the gas valve via the at least one output of the fail safe circuit if/when the gas valve controller provides an input signal that includes the first frequency signal for a first period of time followed by the second frequency signal for a second period of time.

13. The fail-safe circuit of claim 12 wherein the fail-safe circuit is configured to only supply the relay current to the relay to open the gas valve via the at least one output of the fail safe circuit if/when the first frequency signal is not supplied during the second period of time, and the second frequency signal is not supplied during the first period of time.

* * * * *